United States Patent [19]

Boissier

[11] 4,015,373

[45] Apr. 5, 1977

[54] MANHOLE ASSEMBLY WITH REMOVABLE COVER, ESPECIALLY FOR A CARRIAGEWAY

[75] Inventor: Pierre Boissier, Le Chesnay, France

[73] Assignee: Usines et Acieries de Sambre et Meuse, Feignies, France

[22] Filed: Feb. 6, 1976

[21] Appl. No.: 655,965

[30] Foreign Application Priority Data

Feb. 11, 1975 France ..... 75.04235

[52] U.S. Cl. ..... 52/20; 137/371; 404/25

[51] Int. Cl.[2] ..... E02D 29/14

[58] Field of Search ..... 52/19, 20, 21; 404/25, 404/26; 137/371

[56] References Cited

FOREIGN PATENTS OR APPLICATIONS

| | | | |
|---|---|---|---|
| 177,142 | 5/1917 | Canada | 404/25 |
| 664,152 | 1/1952 | United Kingdom | 404/25 |
| 492,190 | 9/1938 | United Kingdom | 52/20 |
| 391,917 | 5/1933 | United Kingdom | 404/25 |
| 1,006,101 | 9/1965 | United Kingdom | 52/19 |
| 263,262 | 12/1926 | United Kingdom | 404/25 |
| 482,517 | 3/1938 | United Kingdom | 404/25 |
| 976,103 | 11/1964 | United Kingdom | 404/25 |

*Primary Examiner*—Price C. Faw, Jr.
*Assistant Examiner*—Henry Raduazo
*Attorney, Agent, or Firm*—Young & Thompson

[57] ABSTRACT

A flat outer frame is provided with an edge-section for receiving a single-piece manhole cover which has three projections located at the apices of a triangle and adapted to rest on the edge-section so as to form a horizontal bearing triangle. Means are provided for locking the cover within the frame so as to prevent tilting of the cover about any one side of the bearing triangle under the action of a downwardly directed force applied to the cover externally of the triangle.

6 Claims, 7 Drawing Figures

MANHOLE ASSEMBLY WITH REMOVABLE COVER, ESPECIALLY FOR A CARRIAGEWAY

This invention relates to a removable manhole cover, especially for a carriageway in which a flat frame constituting a fixed portion of the manhole is anchored horizontally at the level of the carriageway. The frame which is thus fixed in position provides a passageway having a vertical axis surrounded by an edge-section which is so adjusted as to receive the manhole cover, said cover being mounted within the frame along the axis aforesaid in the service position.

Many designs of manhole-cover assemblies of this type are already known, especially those which are constructed of solid cast-iron and are relatively inexpensive to produce. In general, provision is made in the frames of known manhole-cover assemblies and beneath the edge-section which is associated with the cover for a retaining lip which is mounted against the entire periphery of the edge-section in order to retain the cover. In the service position, the entire periphery of the manhole cover must therefore rest on the retaining lip if it is desired to obtain good stability of the cover. This stability is necessary, for example, in order to prevent noisy oscillations of the cover within its frame when heavily loaded vehicles pass over this latter. Oscillations of the cover are also liable to impair the resistance of the frame anchorages in the course of time.

Experience has shown that it is difficult to prevent oscillations of the cover within its frame in the case of manhole assemblies of the type mentioned, even at the cost of careful and accurate machining of the cover seatings. In point of fact, instability of the cover can become apparent as a result of slight deformation of the frame or of the cover, for example as a result of temperature variations or alternatively after accidental and inevitable introduction of a foreign body such as a particle of gravel between the cover and the frame.

In order to improve the stability of some types of manhole cover and especially square or rectangular covers, it has also been proposed to construct them in such a manner as to form a plurality of triangular elements each having inherent stability and assembled with a relative clearance space. However, this expedient is relatively complex and costly and is attended by a number of practical difficulties. Furthermore, this is not a solution which is applicable to covers of the very common circular type.

It is also found that the passing of vehicles can produce vibration of manhole covers of various types, even covers which are made up of several components each having correctly designed stability. In actual practice, a cover which is held in position within its frame solely under the action of its own weight is liable to be lifted by suction of pneumatic types or as a result of the aerodynamic depression which immediately follows the passage of a vehicle. In the event of displacement of the cover, for example after the passage of a fast vehicle or after sustained rebounding caused by several passages of wheels, a serious accident is liable to occur.

The aim of the invention is to overcome the disadvantages mentioned in the foregoing by permitting a simple manhole construction in which the single-piece cover can be mounted in a perfectly stable manner in spite of the practical contingencies referred-to above.

The invention is directed to a manhole assembly fitted with a removable cover especially for a carriageway and comprising a flat frame which is anchored horizontally at the level of the carriageway, said frame being such as to provide a passageway having a vertical axis and surrounded by an edge-section so adjusted as to receive the single-piece cover which is mounted within the frame along the axis aforesaid in the service position.

In accordance with the invention, the aforesaid manhole assembly is distinguished by the fact that the manhole cover has three projections which are disposed at the apices of a triangle and are capable of resting on the edge-section of the frame in order to form a horizontal bearing triangle for the cover, means for locking the cover within the frame being provided so as to prevent tilting of the cover about any one of the sides of the bearing triangle aforesaid under the action of a downwardly directed force applied to the cover externally of said triangle.

The stability of the single-piece cover which is supported on the edge-section of the frame by the three projections disposed in a triangle cannot be affected either by an irregularity of the frame or by a foreign body. Furthermore, the locking means prevent any tilting of the cover if a downwardly directed force is applied thereto externally of the stability triangle. The locking means also prevent untimely lifting of the cover.

As an advantageous feature, the locking means are disposed substantially at each of the three apices of the bearing triangle. This facilitates the construction of the locking means as will be explained hereinafter.

The frame is preferably provided with inclined bearing means adapted to receive the three projections of the cover and to initiate a horizontal movement of rotation of the cover about its vertical axis under the action of the weight of said cover so that the three projections of the cover can be engaged in the locking position within retaining means which are rigidly fixed to the frame in order to prevent lifting of any one of said projections and a tilting movement of the cover with respect to the frame in the locking position aforesaid.

The above-mentioned arrangements ensure automatic locking of the cover after this latter has been placed in position within the frame.

In a preferred embodiment of the invention in which the manhole passageway and the manhole cover are both of circular design, the bearing triangle is equilateral; the three projections of the cover are directed radically and can each rest in the service position within a recess formed in the edge-section of the frame; the recess aforesaid has a bottom wall and an inclined engagement ramp which terminates in said bottom wall and is associated with a first lateral face of the corresponding radial projection of the cover; the same recess is provided opposite to the engagement ramp with a retaining face for the radial projection, said retaining face being associated with a second lateral face of the radial projection which is opposite to the first lateral face. Preferably, the engagement ramp and the retaining face of each recess are each substantially parallel respectively to the associated lateral face to the corresponding radial projection; the slope of the engagement ramp is transverse to a diametrical direction of the cover and chosen so as to ensure horizontal rotational motion of the cover under the action of its weight after positioning within the frame so as to bring the second lateral face of the associated radial projection against the retaining face of each recess; the retaining face aforesaid is directed towards the engagement ramp at an angle of slope with respect to the vertical in order to ensure locking of the radial projection within the recess.

As will be explained hereinafter, the arrangements mentioned above make it possible to ensure stable and efficient locking of the manhole cover in a simple manner in the case of a circular cover.

Further properties and advantages of the invention will become apparent from the following description of two embodiments of the manhole assembly which are presented by way of example without any limitation being implied, reference being made to the accompanying drawings, wherein.

Figure 1:
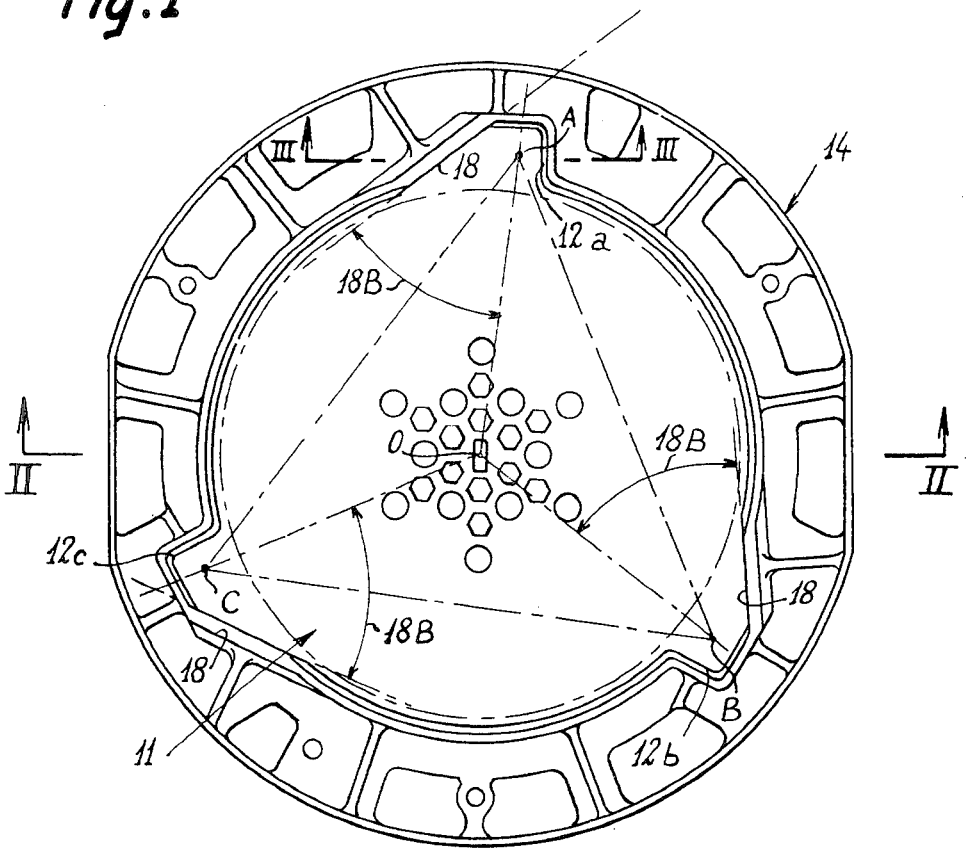
FIG. 1 is a plan view of a first embodiment of the manhole assembly in accordance with the invention.
Figure 4:
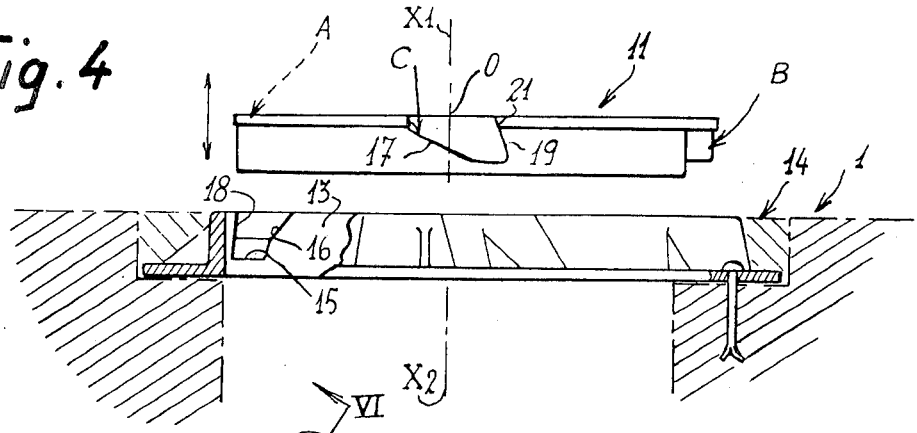
FIG. 4 is a side view, partly in section along the line IV—IV of FIG. 5, of an industrial embodiment of the manhole assembly in accordance with the invention, the manhole cover being shown in the position of introduction into the frame.
Figure 5:
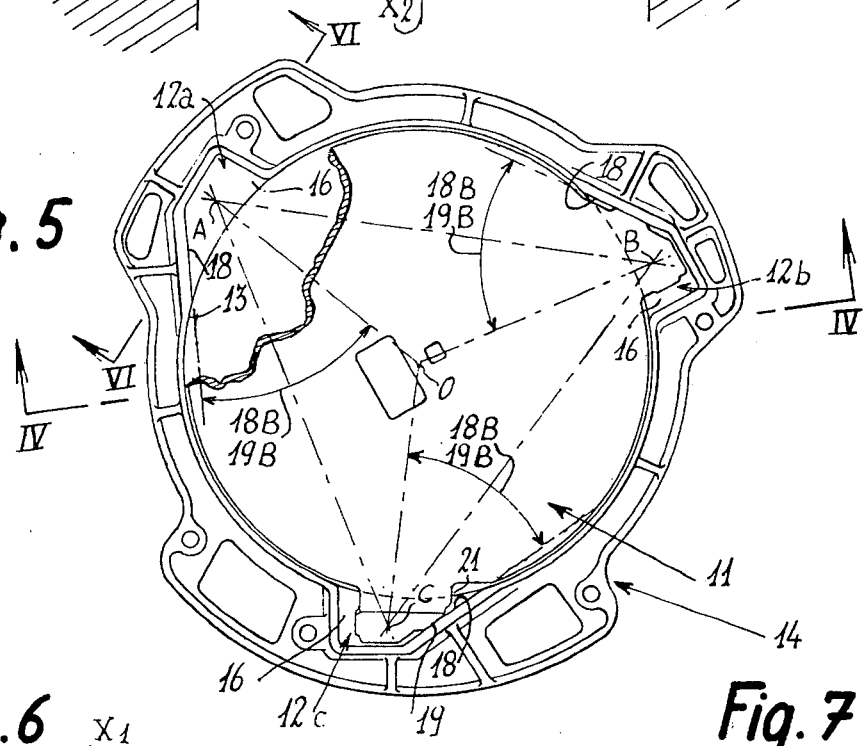
Figure 6:
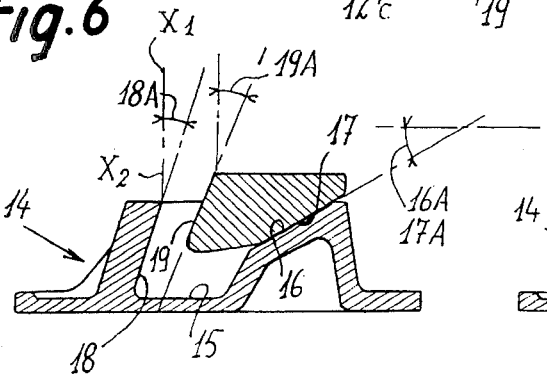
Figure 7:
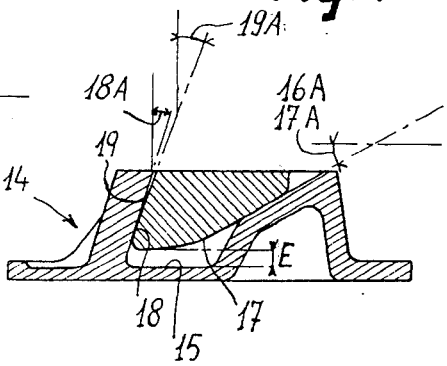

FIG. 5, which is similar to FIG. 1, is a plan view of the manhole assembly of FIG. 4, the manhole cover as shown being locked within the frame in the service position;

FIG. 6 is a sectional view of FIG. 5 taken along line VI—VI and showing a radial projection of the manhole cover in the position of engagement within the recess which is associated with the frame;

FIG. 7, which is similar to FIG. 6, shows the radial projection in the locked position within its recess.

Figure 2:
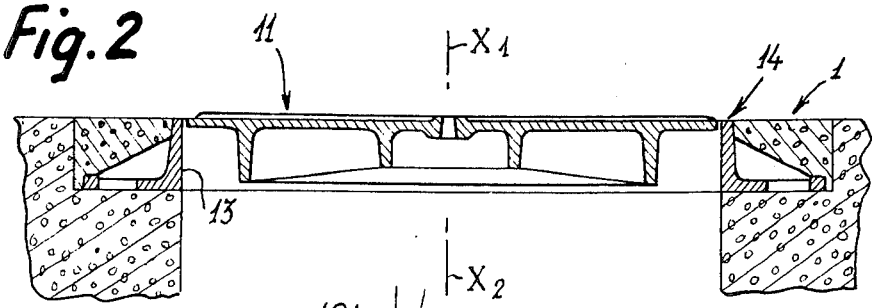
FIGS. 2 and 3 are sectional views taken along the lines II—II and III—III of FIG. 1.
Figure 3:
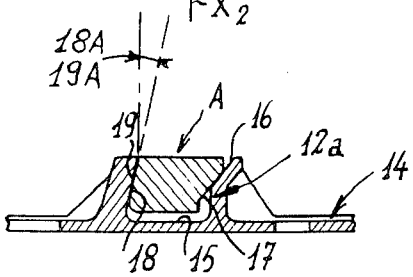

In the embodiment of FIGS. 1 to 3, the manhole assembly which is primarily designed for a carriageway 1 comprises a removable circular manhole cover 11 associated with a flat frame 14 which is anchored horizontally at the level of the carriageway 1 in the service position. The frame 14 provides a passageway having a vertical axis X1–X2 surrounded by an edge-section 13 and this latter is so adjusted as to receive the single-piece cover 11 which is mounted within the frame along the axis X1–X2 in the service position (as shown in FIG. 2).

In accordance with the invention, the manhole cover 11 has three projections A, B, C which are located at the apices of an equilateral triangle and are capable of resting on the edge-section 13 of the frame 14 so as to form a horizontal triangle A-B-C on which the cover is supported. Means for locking the cover 11 within the frame 14 are provided in order to prevent tilting of the cover about any one of the sides of the bearing triangle A-B, B-C, C-A, under the effect of a downwardly directed force which may be applied to the cover externally of the triangle A-B-C.

In the case of a circular manhole (as shown in FIG. 1), the projections A, B, C are identical and preferably located at the apices of an equilateral triangle. The three projections are directed radially towards the exterior of the cover 11 in directions such as O-A, O-B, O-C, where "O" is the center of the circular cover 11. The edge-section 13 which is adjusted with respect to the cover 11 in order to receive this latter is also circular.

In the service position, the three radial projections A, B, C can be brought to bear respectively within three identical recesses 12*a*, 12*b*, 12*c* which are formed in the edge-section 13 of the frame 14. Each recess such as the recess 12*a* (shown in FIG. 3) has a bottom wall 15 to which is joined an engagement ramp having an angle of slope 16A and associated with a first lateral face 17 of the corresponding radial projection A. Opposite to the engagement face 16, each recess such as 12*a* has a retaining face 18 associated with a second lateral face 19 of the projection A which is opposite to the first face 17.

The angle of slope 16A of the engagement ramp 16 is transverse to a diametrical direction of the cover such as A–O (as shown in FIG. 1) and has a value is chosen so as to ensure a horizontal rotational displacement of the cover 11 about its vertical axis X1–X2 under the action of its weight after positioning within the frame 14 in order to bring the second lateral face 19 of the radial projection such as A (shown in FIG. 3) against the retaining face 18 of the recess 12*a*. The retaining face 18 has an obliquity or angle of slope 18A with respect to the vertical, said obliquity being directed towards the engagement ramp 16 in order to ensure locking of the projection A within the recess 12*a*.

There is shown in FIGS. 4 to 7 an industrial embodiment of the invention which is designed to ensure convenient positioning of the manhole cover 11 as well as efficient locking and easy unlocking.

FIGS. 6 and 7 show that, in each recess such as 12*a*, the engagement ramp 16 is parallel to the first lateral face 17 of the radial projection A and has an angle of slope which is substantially equal to 30°. In the locking position of the cover 11 (shown in FIGS. 2 and 4), each radial projection such as A of the cover 11 rests on the engagement ramp 16 is located at a predetermined height "E" above the bottom wall 15 of the recess.

With respect to the vertical, the angle of slope 18A of the retaining face 18 of each recess such as 12*a* is substantially equal to 10° and the same applies to the angle of slope 19A of the associated lateral face 19 of the projection A (as shown in FIGS. 3 and 4). Preferably, the angle of slope 18A of the retaining face 18 is smaller by approximately 1° than the angle of slope 19A of the associated lateral face 19 of the projection such as A. The lower portion of the lateral face 19 thus forms a forwardly-directed nose which is capable of bearing against the retaining face 18. In the horizontal direction (as shown in FIG. 5), the retaining face 18 of each recess such as 12*c* has an angle of slope 18A which is substantially equal to 55° with respect to the corresponding diametrical direction A–O of the cover 11 in the locking position. Similarly, the lateral face 19 of each radial projection such as A has an angle of slope which is substantially equal to 55° with respect to the diametrical direction such as A–O of the cover.

At least one of the radial projections of the cover 11 such as C (shown in FIG. 5) is provided in the lateral face 19 which is associated with the retaining face 18 of the corresponding recess 12*c* with a recess 21 which forms in conjunction with the adjacent edge-section 13 of the frame 14 a passageway for an unlocking tool (not shown in the drawings). This tool can consist of the point of a pick, for example, and serves to impart to the cover 11 a movement of horizontal rotation about its vertical axis X1–X2 in opposition to the action of the engagement ramps 16 in order to move each radial projection such as C of the cover 11 away from the retaining face 18 of the associated recess such as 12*c* and to unlock the cover 11 before disengaging this latter from the frame 14 as will be explained hereinafter.

Consideration will now be given to the use and operation of the manhole assembly consisting of the frame 14 and the removable cover 11 which have just been described with reference to FIGS. 1 to 7.

After anchoring the frame 14 horizontally at the level of the carriageway 1 (as shown in FIGS. 1 and 2), the passageway of the frame 14 having a vertical axis X1–X2 can be closed by introducing the cover 11 into this latter in the flat position. To this end, each radical projection A, B, C of the cover 11 is positioned (as shown in FIG. 4) opposite to one of the recesses 12*a*, 12*b* 12*c* which are formed in the edge-section 13 of the frame. The lateral faces 17 of the three radial projections A, B, C are thus each applied against the engagement ramp 16 of the corresponding recess 12*a*, 12*b*, 12*c*. Under the action of the weight of the cover 11, the slope 16A of the engagement ramp 16 and the parallel slope 17A of the lateral face 17 initiate a helical movement of the cover. The lateral face 19 of each radial projection A, B, C is thus brought to bear against the retaining face 18 of the associated recess such as 12*a* (FIGS. 6 and 7).

As shown in FIGS. 6 and 7, the angles of slope 18A and 19A of the retaining face 18 and of the associated lateral face 19 of the projection A ensure a sufficient effect of overhang of the retaining face 18 with respect to the associated face 19. By virtue of a slightly sharper angle of slope, the lower portion of the lateral face 19 forms a forwardly directed nose, thus ensuring a high local pressure which promotes stability of locking of the projection A against the retaining face 18. This locking action is produced in opposition to the forces of downward displacement which can be applied to the cover 11 in the vertical direction beyond the axis of pivotal motion B–C on the side remote from the stability vertex A under consideration (as shown in FIG. 5).

In order to lock each projection A, B, C of the cover 11 in position, the horizontal obliquity 18A, 19A of the associated faces 18, 19 (shown in FIG. 5) facilitates the application of the lateral face 19 of each radial projection A, B, C against the retaining face 18 of the corresponding recess 12*a*, 12*b*, 12*c* in much the same manner as a wedge. The obliquity 18B, 19B also facilitates unlocking of the projections A, B, C as will be explained hereinafter.

The triangular arrangement of the recesses 12*a*, 12*b*, 12*c* of the frame 14 and of the associated radial projections A, B, C ensures continuous and simultaneous contact of the lateral faces 17 against the engagement ramps 16 (shown in FIGS. 3, 4). This ensures both the stability of the cover 11 in the locking position and the uniform helical motion of this latter either in the downward or upward direction either for locking or for unlocking.

Careful manufacture of the case steel cover 11 and of the frame 14 which is manufactured in the same manner permits of accurate contact between the associated surfaces of the recesses 12 and the radial projections A, B, C. In particular, accurate and simultaneous contact of the lower noses of each lateral face 19 (as shown in FIGS. 6, 7) with the retaining face 18 is thus obtained at the moment of locking, taking into account the slight elasticity of the metal, even when this latter is left in the as-cast state and simply deburred without any final machining operation.

It has already been noted that, in the locking position (FIG. 7), each radial projection such as A (FIG. 7) remains at a predetermined height E above the bottom wall 15 of the corresponding recess 12*a*. The height E chosen by way of example is of the order of 10 or 12 mm and is distinctly greater than the grain size of gravel particles and other foreign bodies which may escape from summary cleaning of each recess 12 prior to positioning of the cover 11 within the frame 14.

In order to unlock the cover 11 (as shown in FIG. 5), a tool such as the point of a pick (not shown) is inserted into the passage formed by the recess 21 and the adjacent edge-section 13 on the side corresponding to the retaining face 18 which is associated with one of the radial projections such as C. By using the tool to produce a leverage effect, a horizontal movement of rotation is imparted to the cover 11 in opposition to the action of the engagement ramps 16. Each projection A, B, C is thus moved away from the associated retaining ramp 18 in order to unlock the cover and then disengage this latter from the frame 14.

Within each recess 12*a*, 12*b*, 12*c*, the parallel arrangement of the engagement ramp 16 and of the lateral face 17 of the corresponding radial projection such as A (FIGS. 6 and 7) facilitates the sliding contact of each radial projection along the associated ramp 16 in both directions.

It is thus apparent that the manhole-cover assembly in accordance with the invention offers a number of advantages over known assemblies. By virtue of the triangular arrangement of the projections A, B, C, complete stability of the single-piece cover 11 is achieved with respect to the frame 14 even if an irregularity of shape or a foreign body causes a slight displacement of the cover with respect to the bearing position normally provided for this latter on the edge-section 13 of the frame 14. The means for locking the cover 11 within the frame 14 prevent tilting of the cover with respect to any one of the sides of the bearing triangle A-B-C under the action of any downwardly directed force which may be applied to said cover externally of the triangle aforesaid.

In the case of a circular cover, the equilateral bearing triangle A-B-C facilitates the assembly of the cover 11 in three possible positions, the radial projections A, B, C and the recesses 12*a*, 12*b*, 12*c* which are respectively identical being disposed in the same manner about the vertical axis X1–X2. The slope 16A of the engagement faces 16 and the parallel slope 17A of the lateral face 17 as well as the double obliquity 18A, 18B of the retaining face 18 and the parallel obliquity 19A, 19B (FIGS. 2, 3, 4) of the associated lateral face 19 ensure efficient and automatic locking of each projection A, B, C within the associated recess 12. Similarly, the slopes and obliquities aforesaid facilitate unlocking of the cover 11, this being achieved by means of the recess 21 which permits the introduction of an unlocking tool.

The cast-steel construction of the frame 14 and of the cover 11 makes it possible to construct a high-strength lightweight manhole-cover assembly. The bearing and locking elements of said assembly have surfaces which are adjusted in accurately interfitting relation even when the metal is left in the as-cast condition without being subjected to any final machining operation.

The means for effective locking of the relatively lightweight cast steel cover in accordance with the invention have the further advantage of preventing untimely lifting of said cover. In fact, said means prevent marked vibrations and rebounding of the cover which would be liable to occur, for example as a result of the elasticity of the frame and of the cover when the wheels of a heavy vehicle pass over this later. Similarly, the locking means act in opposition to the aerodynamic depression effect to which the cover is subjected immediately after the passage of a fast vehicle.

In order to obtain the same strength and the same resistance in the case of a manhole assembly of ordinary cast iron, it would be necessary to employ a cover and a frame which are of substantially greater thickness, therefore heavier and less convenient to employ in practice. Moreover, the bearing and locking elements provided by the invention cannot be accurately formed by means of an ordinary cast-iron construction.

It is readily apparent that the invention is not limited to the embodiments described in the foregoing by way of example and that a number of different alternative forms can be contemplated without thereby departing either from the scope or the spirit of the invention.

It is evident, for example, that the invention is also applicable to non-circular manholes fitted for example with square or rectangular covers (not shown in the drawings). The bearing projections of the cover which are similar to the projections A, B, C of FIG. 1, are in that case disposed for example at each of the two ends of one side of the cover and at the center of the opposite side.

We claim:

1. In a manhole assembly fitted with a removable cover especially for a carriageway and comprising a flat frame which is anchored horizontally at the level of the carriageway in the service position, the said frame being such as to provide a passageway having a vertical axis and surrounded by an edge-section of the frame so adjusted as to receive the cover which is mounted within the frame along the axis aforesaid in the service position, the cover having three radial projections which are disposed at the apices of a triangle and are capable of resting on the edge-section of the frame in order to form a horizontal bearing triangle for the cover, the edge-section of the frame being provided with three recesses each comprising inclined bearing means adapted to receive a first lateral face of one of the three radial projections of the cover and to initiate a horizontal movement of rotation of the cover about its vertical axis under the action of the weight of the cover; the improvement comprising a retaining face defining one side of said recess and which is inclined downwardly outwardly away from said axis thereby to lock the projection in the recess against tilting movement of the cover about a side of said triangle.

2. An assembly as claimed in claim 1, said retaining face forming an angle of about 55° with a radial line that passes through said axis and said retaining face.

3. An assembly as claimed in claim 1, there being a passage, in the locked position of the cover, between a part of the edge section of the frame and an opposite side face of a said projection, for inserting an unlocking tool for unlocking the cover.

4. An assembly as claimed in claim 1, in which the cover and frame are of cast metal in the as-cast state.

5. An assembly as claimed in claim 1, in which said retaining face is also inclined downwardly in the direction in which the cover turns under the action of the weight of the cover.

6. An assembly as claimed in claim 1, in which the surface of the projection that contacts said retaining face is inclined to the vertical at a larger angle than said retaining face, thereby to promote contact between a lower portion of the last-named surface and a lower portion of said retaining face.

* * * * *